United States Patent [19]

Pielechowski et al.

[11] Patent Number: 4,887,724

[45] Date of Patent: Dec. 19, 1989

[54] TIERED TRAY ASSEMBLY

[75] Inventors: Craig A. Pielechowski, Holland, N.Y.; James S. Panzarella, North Kingston, R.I.

[73] Assignee: Smith Metal Arts Co., Inc., Buffalo, N.Y.

[21] Appl. No.: 236,456

[22] Filed: Aug. 25, 1988

[51] Int. Cl.[4] ..... A47F 5/00

[52] U.S. Cl. ..... 211/11; 211/126; D19/92

[58] Field of Search ..... D19/92; 211/126, 10, 211/11, 50, 194

[56] References Cited

U.S. PATENT DOCUMENTS

| | | | |
|---|---|---|---|
| D. 112,711 | 1/1939 | Braun et al. . | |
| D. 144,450 | 4/1946 | Cohen . | |
| D. 249,048 | 8/1978 | Drell et al. . | |
| D. 261,904 | 11/1981 | Polhemus . | |
| 2,235,709 | 3/1941 | Hearn et al. . | |
| 2,334,825 | 11/1943 | Jones . | |
| 2,721,663 | 10/1955 | James . | |
| 3,482,708 | 12/1969 | Levit et al. . | |
| 3,533,512 | 10/1970 | Serwer . | |
| 3,648,849 | 3/1972 | Harris et al. . | |
| 4,074,810 | 2/1978 | Juergens et al. . | |
| 4,253,402 | 3/1981 | Carrig et al. . | |
| 4,353,470 | 10/1982 | Polhemus et al. . | |
| 4,534,475 | 8/1985 | Mayo . | |
| 4,657,148 | 4/1987 | Heng | 211/194 X |

*Primary Examiner*—Robert W. Gibson, Jr.

[57] ABSTRACT

A tiered desktop tray assembly including a lower tray and an upper tray utilizes a pair of spacer brackets operatively connected between the trays for supporting the upper tray and the lower tray. The spacer brackets are maintained in a stressed condition while interconnected between the upper and lower trays so that the interconnected relationship of the brackets and trays is enhanced by the stress under which the spacer brackets is maintained.

5 Claims, 2 Drawing Sheets

Fig. 8.
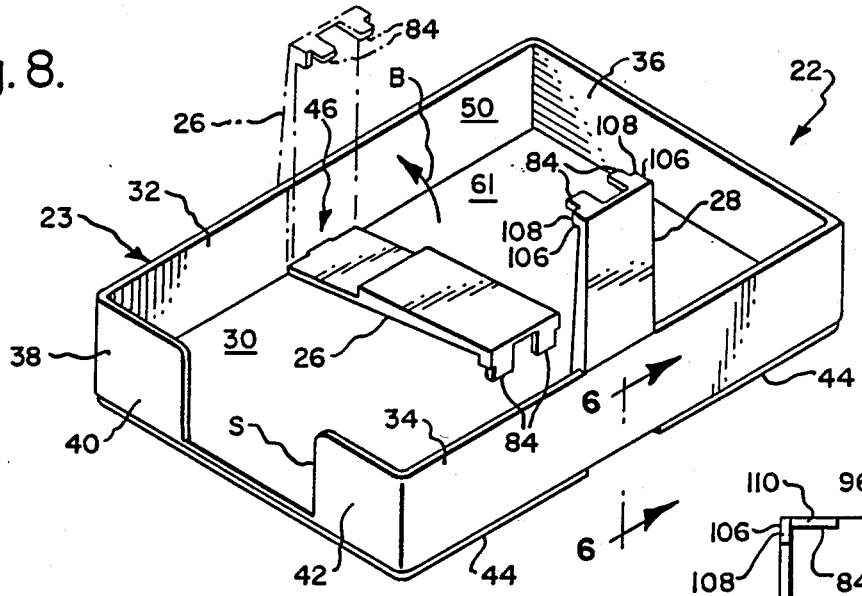
Fig. 5.
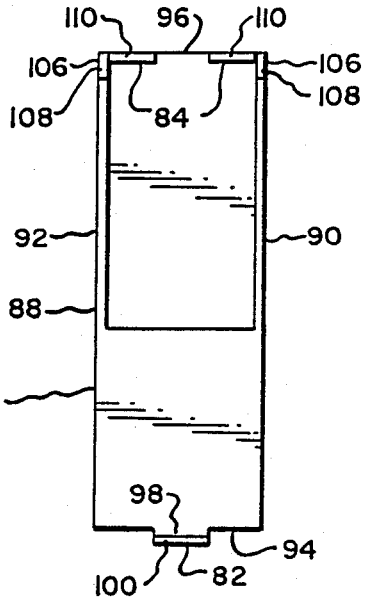
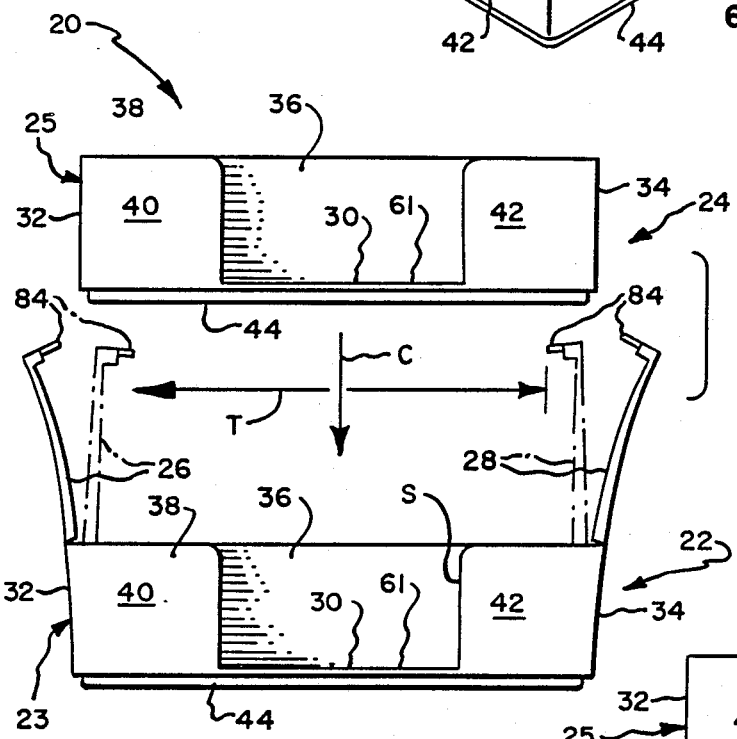
Fig. 9.
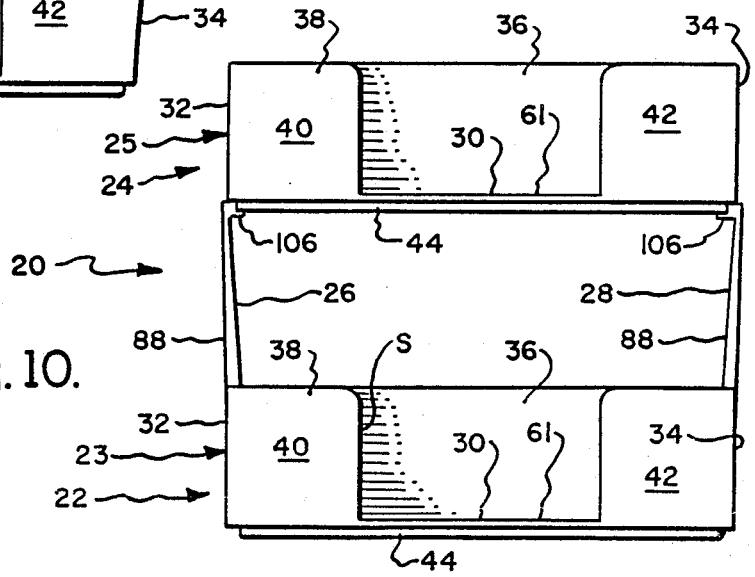
Fig. 10.

TIERED TRAY ASSEMBLY

BACKGROUND OF THE INVENTION

This invention relates generally to desktop office accessories and relates more particularly to desk trays, such as letter trays, which are stackable in a tiered arrangement.

The type of desk tray with which this invention is concerned includes a receptacle portion having a bottom and two opposite sidewalls joined to the bottom so as to extend upwardly therefrom. Commonly, the tray is open-topped and utilized for holding a quantity of papers in a generally horizontally-disposed, stacked arrangement.

It is known that for purposes of saving space upon a desktop, two trays of the aforedescribed type can be stacked in a supeposed relationship by means of spacer brackets interposed between the two trays. Commonly, each such bracket has a lower portion which cooperates with the lower one of the trays and an upper portion which cooperates with the upper one of the trays so that when operatively connected between the upper and lower trays, the brackets or spacers maintain the trays in a vertically-spaced, tiered arrangement. Examples of stackable trays utilizing such brackets are shown and described in U.S. Pats. Nos. 4,353,470, 4,074,810, 3,648,849, 3,482,708 and 3,533,512.

It is an object of the present invention to provide a new and improved tiered tray assembly.

Another object of the present invention is to provide such a tray assembly wherein the tiered arrangement of trays stacked therein are maintained in a relatively stable condition.

Still another object of the present invention is to provide such a tray assembly having a construction which enhances the maintenance of the trays thereof in the tiered arrangement.

Yet still another object of the present invention is to provide such a tray assembly which can be quickly and easily assembled and disassembled.

A further object of the present invention is to provide such a tray assembly which is uncomplicated in structure and economical to construct.

SUMMARY OF THE INVENTION

This invention resides in an improved desktop tray assembly including a lower tray, an upper tray and a pair of spacer brackets operatively connected between the lower and upper trays for supporting the upper tray above the lower tray.

It is a feature of the invention that the spacer brackets are maintained in a stressed condition while supporting the upper tray above the lower tray so that the interconnected relationship between the brackets and trays is enhanced by the stress under which the spacer brackets is maintained.

BRIEF DESCRIPTION OF THE DRAWING FIGURES

FIG. 5 is a side elevation view of the spacer bracket of FIG. 4 as seen generally from the right in FIG. 4.

FIG. 8 is a perspective view of the lower tray and spacer brackets of the FIG. 1 assembly illustrating steps involved in positioning the brackets within the lower tray.

FIG. 9 is a front elevation view of the FIG. 1 assembly before attachment of the upper tray to the spacer brackets.

FIG. 10 is a view similar to that of FIG. 9 of the FIG. 1 assembly shown after attachment of the upper tray to the spacer brackets.

DETAILED DESCRIPTION OF THE ILLUSTRATED EMBODIMENT

Figure 1:
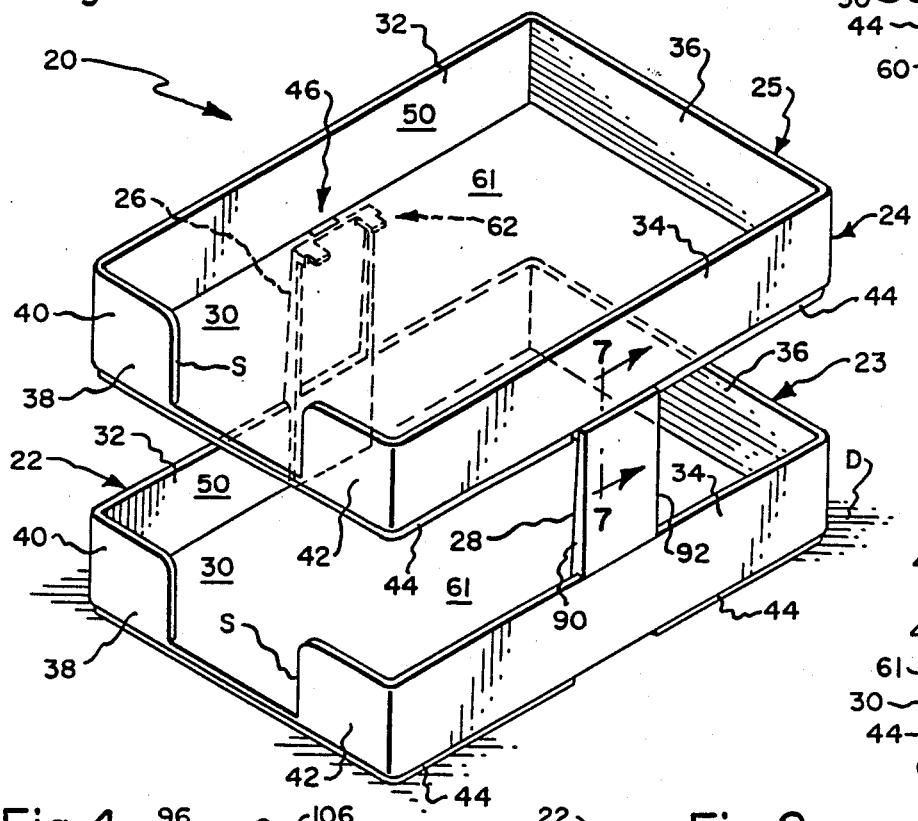
FIG. 1 is a pespective view of a tiered tray assembly in accordance with the present invention.

Turning now to the drawings in greater detail and considering first FIG. 1, there is shown an embodiment of a desk tray assembly, generally indicated 20 and in accordance with the present invention, shown operatively positioned upon a desktop D. The desk tray assembly 20 includes a lower tray 22, an uppper tray 24 and a pair of spacer brackets 26,28, operatively connected between the upper and lower trays 22 and 24. As is explained in greater detail herein, the brackets 26 and 28 cooperate with each of the lower and upper trays 22 and 24 for maintaining the trays 22,24 in a stable supeposed or tiered relationship.

Figure 2:
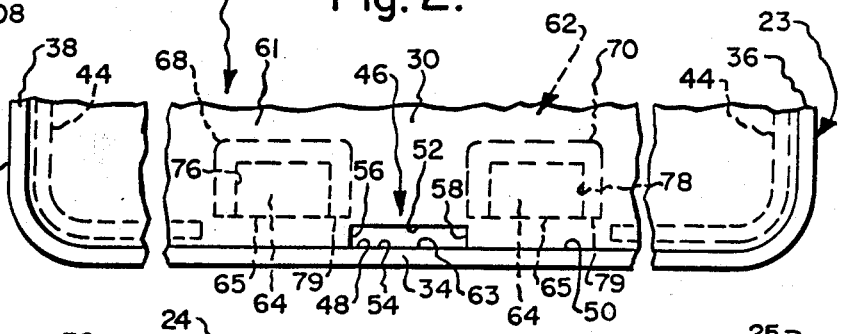
FIG. 2 is a fragmentary top plan view of a portion of the lower letter tray of the FIG. 1 assembly shown with the upper tray and brackets having been removed therefrom.

With reference to FIGS. 1 and 2, each desk tray 22 or 24 has a receptacle portion 23 or 25, respectively, including a planar bottom 30, two opposite sidewalls 32,34, a back wall 36 and a front 38 including two front wall partitions 40,42 defining a space S therebetween. Each sidewall 32 or 34 is generally parallel to the other sidewall 34 or 32 and is joined at a right corner to each of the back wall 36 and a corresponding one of the front wall partitions 40,42. Furthermore, each of the sidewalls 32,34, backwall 36 and front 38 is integrally joined to the bottom 30 so as to extend generally upwardly therefrom and so as to form a right angle therewith. For a reason appparent herein, each of the bottom 30, sidewalls 32,34, back wall 36 and front 38 of the trays 22 or 24 is constructed of a resilient material, such as a relatively hard plastic, providing each part of the tray receptacle portion 23 or 25 with a degree of felxibility. Preferably, each tray receptacle portion 23 or 25 is formed by a molding process so that the tray bottom 30, sidewalls 32,34, back wall 36 and front 38 are integrally joined.

Figure 6:
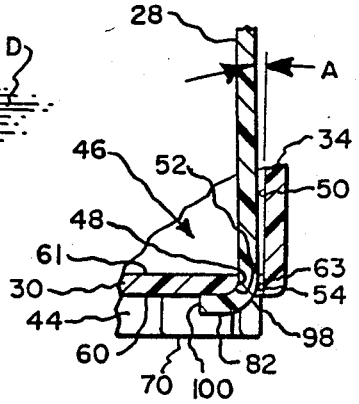
FIG. 6 is a cross-sectional view taken about on lines 6—6 of FIG. 8.

The lower tray 22 further includes a downwardly-projecting rib 44 attached to so as to project from the downwardly-facing surface, indicated 60 in FIG. 6, of the bottom 30. With reference again to FIG. 1, the rib 44 extends for a substantial distance around the peimeter of the bottom 30 and adjacent the edges thereof and provides a support between the desktop D and the receptacle portion 23 of the lower tray 22.

A desk tray such as either of the trays 22 and 24 described and illustrated herein is commonly referred to as a letter tray and is open-topped for accepting a quantity or stack of paper (not shown) positioned upon the bottom 30. When operatively positioned upon the bottom 30 or, more specifically, the upwardly facing support surface 61 of the bottom 30, the quantity of paper is arranged in a generally horizontally-disposed orientation. The spacing S defined between the front wall partitions 40 and 42 accommodates the movement of a hand into and out of a corresponding tray receptacle portion 23 or 25 for the purpose of placing paper within or removing paper from the tray 22 or 24.

With reference to FIGS. 1 and 2, and in accordance with the present invention, the lower tray 22 includes means, generally indicated 46, defining a slot 48 located in the bottom 30 and adjacent the inside surface, indicated 50, of each tray sidewall 32 or 34. Each slot 48 extends between the upwardly-facing and downwardly-facing surfaces 61 and 60, respectively, of the bottom 30, and as viewed in the plan view of FIG. 2, has an upwardly-directed opening 62, is elongated in shape and substantially rectangular in cross section. Furthermore, each slot 48 is located adjacent its corresponding sidewall 32 or 34 so as to be positioned intermediate of the back wall 36 and front 38 and generally opposite the other slot 48.

With reference to FIGS. 2 and 6, each slot 48 defines two opposite sides 52,54 and two opposite ends 56,58 extending between the sides 52,54. Each slot 48 is formed in such a relationship to its adjacent or corresponding sidewall 32 or 34 that its side 54 is provided by the inside surface 50 of the sidewall 32 or 34. Furthermore, and as best shown in FIG. 6, the downwardly-facing surface 60 of the tray bottom 30 forms a rounded corner with the side 52 of each slot 48.

Figure 7:
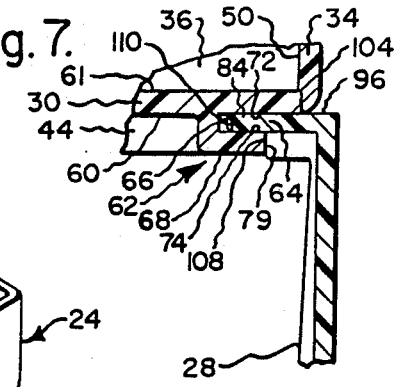
FIG. 7 is a cross-sectional view taken about on lines 7—7 of FIG. 1.
Figure 3:
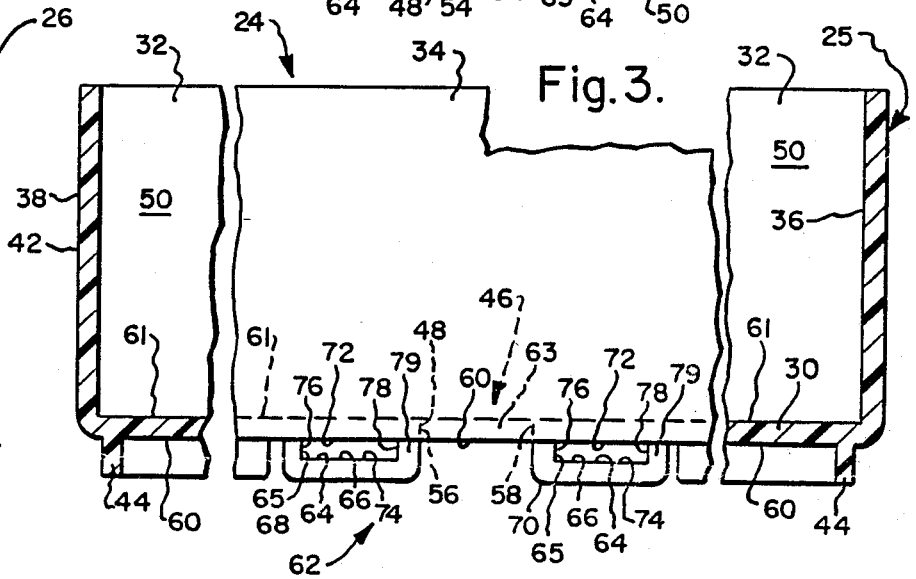
FIG. 3 is a fragmentary side elevation view, shown partially in section, of a portion of the upper tray of the Fig. 1 assembly shown with the lower tray and brackets having been removed therefrom.

With reference to FIGS. 3 and 7, the upper tray 24 includes means, generally indicated 62, defining a pair of slots 64,66 in the tray bottom 30 and immediately beneath each tray sidewall 32 or 34. In the tray embodiment 24, each slot 64 or 66 is provided by a pocket 68 or 70, respectively, molded or otherwise formed in the bottom 30 so as to depend downwardly from the downwardly-facing surface 60 of the tray bottom 30. As best shown in FIG. 3, each slot 64 or 66 has an outwardly-directed opening 65 which is elongated in shape and substantially rectangular in cross section. Furthermore, the pocket 68 or 70 providing the corresponding slot 64 or 66 has inside walls defining two opposite sides 72 and 74 and two opposite ends 76 and 78 of the slot 64 or 66. Still further, the opening 65 of each slot 64 or 66 is bordered by an outwardly-directed edge surface 79.

Figure 4:
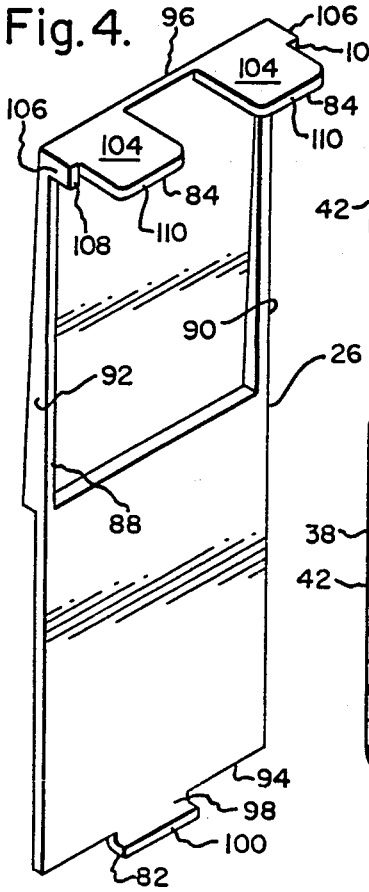
FIG. 4 is a perspective view of one of the spacer brackets of the FIG. 1 assembly.

As exemplified by the spacer bracket 26 of FIG. 4, each spacer bracket 26 or 28 includes means defining a lower tab 82, means defining a pair of upper tabs 84 and a central portion 88 disposed intermediate of the lower tab 82 and upper tabs 84. The central portion 88 is elongated and generally platen-like in shape so as to define two opposite side surfaces 90,92, a lower edge 94 and an upper edge 96. The lower tab 82 is joined to the central portion 88 so as to extend from the lower edge 94 thereof, and the upper tabs 84 are joined to the central portion 88 so as to extend from the upper edge 96 thereof. Each bracket 26 or 28 is molded of a suitable material, such as relatively hard plastic, which provides the bracket with a degree of rigidity yet flexible and resilient enough to accommodate a forced flexing of each bracket central porition 88 out of the plane of each side surface 90 or 92 and a springing back of the bracket to a straight, undeformed condition once flexing forces are relieved therefrom.

With reference to FIGS. 4 and 6, the lower tab 82 of each bracket 26 or 28 is somewhat L-shaped in cross section so as to define two legs 98 and 100. One leg 98 is joined to the lower edge 94 so that its opposite side surfaces are extensions of the side surfaces 90 and 92 of the central portion. The other leg 100 is joined at a rounded corner to the lower end of the leg 98 so as to extend generally perpendicular to the leg 98. Furthermore, each tab 82 is located substantially midway along the length of the lower edge 94 so that portions of the lower edge 94 are positioned outboard of the tab 82.

In accordance with the present invention, the lower tab 82 is of such size and shape to be cooperatively received by a corresponding one of the upwardly-opening slots 48 defined in the bottom 30 of the lower tray 22 for joining the bracket 26 or 28 to the lower tray 24. To this end, the tab legs 98 are slightly smaller in cross section than that of the slot opening 63 so that the tab legs 98 and 100 can be inserted therethrough. When each tab 82 is operatively positioned within a corresponding slot 48 and, as best shown in FIG. 6, the tab leg 98 is positioned between the slot sides 52 and 54 and the tab leg 100 is positioned beneath and in engagement with the downwardly-facing surface 60 of the tray bottom 30. Furthermore, the bracket 26 or 28 is supported within the lower tray 22 when operatively positioned therein so that the lower edge 94 of the bracket 26 or 28 rests upon the tray bottom 30 and adjacent the tray sidewall 32 or 34.

Each of the brackets 26 or 28 is positionable in operative interconnecting relationship with its corresponding slot 48 in a first position as illustrated in FIG. 6 at which the bracket side 92 is angularly disposed in relation to the adjacent tray sidewall 32 or 34 and at which the bracket 26 or 28 is in an unstressed or unflexed condition. More specifically and in the aforesaid first position, the bracket side 92 forms an angle A with the adjacent surface of the sidewall 32 or 34, which angle A opens generally upwardly along the sidewall 32 or 34 as shown in FIG. 6.

In acordance with the present invention and with reference to FIGS. 6 and 9, each of the brackets 26 or 28 is adapted to be forcibly flexed or moved relative to the lower tray 22 from the first, or FIG. 6 position, to a second position as illustrated in solid lines in FIG. 9. More specifically, each of the brackets 26 or 28 can be flexed so that its upper tabs 84 are moved from a first position, as illustrated in phantom in FIG. 9, at which the upper tabs 84 are disposed directly above the tray bottom 30 to a second position, as illustrated in solid lines in FIG. 9, at which the tabs 84 are positioned generally above and to one side of the tray bottom 30. During such a flexing, the lower tab 82 of each bracket 26 or 28 remains anchored within the slot 48, the tab leg 100 bears against the downwardly-facing surface 60 of the tray bottom 30 and the flexibility of the materials out of which the receptacle portion 23 and brackets 26,28 are constructed accommodates such a flexing. Furthermore and inasmuch as a flexing of the brackets 26,28 out of the FIG. 6 first position places the brackets 26,28 in a stressed condition, the resiliency or memory of the receptacle portion 23 and the brackets 26,28 effects a biasing of the brackets 26,28, when flexed out of the FIG. 6 first position to, for example, the second, or FIG. 9 solid line, position toward the FIG. 6 first position.

With reference again to FIG. 4, each of the upper tabs 84 includes a generally platen-like top portion 104 and a side portion 106 joined to one side of the top portion 104. Each side portion 106 defines an abutment surface 108 which generally faces in the same direction as does the free end, indicated 110, of its corresponding tab 84. More specifically, each tab 84 is arranged in relation to the bracket central portion 88 so that each abutment surface 108 and tab free end 110 is directed to one side of the bracket central portion 88. In the bracket embodiment illustrated in FIG. 4, the top portion 104 of each tab 84 is arranged generally at a right angle to the central portion side surface 90 so that the tab free ends 110 are directed generally away from the side surface 90.

In accordance with the present invention and with reference to FIG. 7, the upper tabs 84 are adapted to be cooperatively received by the slots 64, 66 defined in the bottom 30 of the upper tray 24 for purposes of joining the upper tray 24 to the brackets 26,28. To this end, the top portion 104 of each upper tab 84 is of such size so as to be slidably and snuggly received by a corresponding one of the slot-defining pockets 68 or 70 when inserted free-end-first through the slot opening. Accordingly, the width and thickness of each tab top portion 104 is slightly smaller than the width and thickness of the corresponding slot opening 65 within which the top portion 104 is positionable. Furthermore, it follows that the upper tabs 84 are spaced a distance apart which is about equal to the distance as measured between the slot openings 65 so that the tabs 84 can be inserted together within the slots 64,66.

In order to assemble the tray assembly 20 and with reference to FIGS. 8–10, the brackets 26,28 are initially and operatively connected to the lower tray 22. To connect the brackets 26,28 to the lower tray 22 and as illustrated in FIG. 8, the lower tab 82 of each bracket 26 or 28 is manipulated into corresponding slot 48 defined in the tray bottom 30 until each bracket 26 or 28 is oriented in its first position as illustrated in FIG. 6. Inasmuch as each lower tab 82 is L-shaped in cross-section, it will be understood that each bracket 26 or 28 must be oriented in a generally flat condition within the tray 22 as is illustrated by the solid-line condition of bracket 26 in FIG. 8 in order to direct the tab leg 100 into the corresponding slot 48. Once the tab leg 100 is received by the slot 48, the bracket 26 or 28 is moved or pivoted relative to the tray bottom 30 in the direction indicated by the arrow B to orient the bracket 26 in an its first, or FIG. 6, position. As the bracket 26 is moved or pivoted as aforesaid, the other leg 98 of the tab 82 moves into the slot 48 and the tab leg 100 engages the downwardly-facing surface 60 of the tray bottom 30.

When the brackets 26,28 are operatively positioned within the lower tray 22 and oriented upright as aforedescribed, the brackets 26,28 assume the positions illustrated in phantom in FIG. 9. In such a condition, the spacing, indicated T, defined between the opposing tabs 84,84 of the brackets 26,28 is insufficient to permit the upper tray 24 to be lowered or positioned therebetween. Consequently, the brackets 26,28 must be forcibly flexed apart to the condition of the brackets 26,28 illustrated in solid lines in FIG. 9, or the aforedescribed second position of the brackets 26,28. Once the brackets 26,28 are forcibly flexed to the FIG. 9 solid-line condition, the upper tray 24 is lowered in the direction of the arrow C until the outwardly-opening slots 64,66 are generally aligned with the free ends 110 of the bracket upper tabs 84. At that point, the free ends 110 of the tabs 84 are inserted or otherwise manipulated into the openings of the pockets 68,70 until the abutment surface 108 abuts the outwardly-directed edge surface 79 of the pockets 68,70 so that the tabs 84 are operatively positioned within the slots 64,66. As the brackets 26,28 are manipulated into the slots 64,66, brackets 26,28 are moved or flexed from the FIG. 9 solid line positions to the bracket positions illustrated in Fig. 10.

With the upper tabs 84,84 of the brackets 26,28 operatively positioned within the slots 64,66 of the upper tray 24 and as illustrated in FIG. 10, the central portion 88 of each bracket 26 or 28 is oriented generally vertically and the brackets 26,28 are operatively interconnected between the upper and lower trays 22,24. It will be understood that when in the FIG. 10 vertically-oriented positions, the brackets 26,28 are positioned in positions intermediate of the FIG. 9 phantom-line (unstressed) and solid-line (stressed) positions. Hence, when positioned in the aforesaid FIG. 10 intermediate position at which the brackets 26,28 are operatively connected to the upper tray, the memory of the brackets 26,28 continually urges or biases the brackets 26,28 toward the FIG. 9 phantom-line (unstressed) condition so that the uppper tabs 84 of the brackets 26,28 are urged toward one another and so that the bracket abutment surfaces 108 bear against the outwardly-directed edges 79 of the pockets 68,70, of the upper tray 24 as shown in FIG. 7. Therefore, the brackets 26,28 and lower tray 22 cooperate in such a manner that the upper tray 24 is effectively squeezed between the brackets 26,28.

The aforedescribed securement of the upper tray 24 between the brackets 26,28 is advantageous in that the upper tray 24 cannot be disconnected from the brackets 26,28 unless the brackets 26,28 are forcibly flexed away front one another toward the FIG. 9 solid-line condition. Hence, the lower tray 22 and brackets 26,28 connected thereto resist an unintended or accidental dismantling of the assembly 20 and thereby enhances the interconnected relationship between the brackets 26,28 and the trays 22,24. Furthermore, the aforedescribed biasing of the bracket tabs 84,84 toward one another is advantageous in that the assembly components are maintained in a relatively tight arrangement promoting the stability of the assembly 20.

In the assembly embodiment 20, the upper and lower trays 22,24 are of identical construction. Therefore, like the lower tray 22, the upper tray 24 includes means 46 defining a pair of slots 48 in the bottom thereof and adjacent the sidewalls 32,34 and a downwardly-projecting support rib 44 depending from the bottom 30 of the tray 24. Further, like the upper tray 24, the lower tray 22 includes means 62 defining a pair of slots 64,66 in the tray sidewall 32 or 34. As illustrated in FIGS. 2 and 3, the slot 48 of the slot-defining means 46 is positioned generally between the slots 64,66 of the slot-defining means 62 of each tray 22,24. Such a likeness or similarity between construction of the upper and lower trays 24,22 permits the use of the lower tray 22 as the upper tray and the use of the upper tray 24 as the lower tray.

It will be understood that numerous modifications and substitutions can be had to the aforedescribed embodiment without departing from the spirit of the invention. Accordingly, the aforedescribed embodiment is intended for purposes of illustration and not as limitation.

We claim:

1. A tiered desktop tray assembly having lower and upper trays, each of the trays having a bottom and laterally spaced apart sidewalls, and a pair of generally vertically extending laterally spaced apart spacer brackets disposed adjacent the laterally spaced apart sidewalls for supporting the upper tray above the lower tray;

characterized by the laterally spaced apart sidewalls of the lower tray being formed of a resilient material, and by a lower end portion of each of the spacer brackets being disposed within the lower tray with an upper part of the lower end portion contacting an upper inner surface of the adjacent resilient sidewall with the lower end of the lower end portion being held from movement away from the adjacent sidewall, the parts being designed so that when the spacer brackets are assembled to the upper and lower trays upper end parts of the spacer brackets are biased into firm engagement with the upper tray by the resilient sidewalls to cause the upper tray to be effectively held between the spacer brackets.

2. The tiered desktop tray assembly as set forth in claim 1 wherein each of the laterally spaced apart spacer brackets is formed of a resilient material, said brackets being resiliently stressed when assembled to cause the upper ends of said brackets to be biased towards one another.

3. A tiered desktop tray assembly having lower and upper trays, each of the trays having a bottom and laterally spaced apart sidewalls, and a pair of generally vertically extending laterally spaced apart spacer brackets disposed adjacent the laterally spaced apart sidewalls for supporting the upper tray above the lower tray;

characterized by the bottom of the lower tray being provided with a pair of slots, each slot being located immediately inboard of an adjacent sidewall, and by a lower end portion of each of the spacer brackets being disposed within the lower tray, with an upper part of the lower end portion contacting an upper inner surface of the adjacent sidewall and with the lower end of the lower end portion being provided with a lower tab which is received within an associated slot to hold the lower end portion from movement away from the adjacent sidewall, and wherein an upper end part of each of the spacer brackets is resiliently biased into firm engagement with the upper tray so that the upper tray is effectively squeezed between the spacer brackets.

4. A tiered desktop tray assembly having lower and upper trays, each of the trays having a bottom and laterally spaced apart sidewalls, and a pair of generally vertically extending laterally spaced apart spacer brackets disposed adjacent the laterally spaced apart sidewalls for supporting the upper tray above the lower tray;

characterized by the upper tray having a pair of spaced apart laterally outwardly opening receiving means adjacent the sidewalls thereof, and by a lower end portion of each of the spacer brackets being disposed within the lower tray with an upper part of the lower end portion contacting an upper inner surface of the adjacent sidwall with the lower end of the lower end portion being held from movement away from an adjacent sidewall, and wherein an upper end part of each of the spacer brackets is resiliently biased into an associated receiving means of the upper tray so that the upper tray is effectively supported by the spacer brackets.

5. The tiered desktop tray assembly as set forth in claim 4 wherein each of the receiving means includes front and rear pockets and wherein the upper end portion of each of the spacer brackets is provided with a pair of inwardly extending upper tabs which are received within the pockets.

* * * * *